US009707157B2

(12) United States Patent
Wu

(10) Patent No.: US 9,707,157 B2
(45) Date of Patent: Jul. 18, 2017

(54) MULTI-MEDICAMENT CONTAINER

(76) Inventor: Kuo-Cheng Wu, Kaohsiung (TW)

( * ) Notice: Subject to any disclaimer, the term of this patent is extended or adjusted under 35 U.S.C. 154(b) by 0 days.

(21) Appl. No.: 13/180,615

(22) Filed: Jul. 12, 2011

(65) Prior Publication Data

US 2013/0018352 A1 Jan. 17, 2013

(51) Int. Cl.
*A61J 1/20* (2006.01)
*A61J 1/14* (2006.01)

(52) U.S. Cl.
CPC ..... *A61J 1/2093* (2013.01); *A61J 1/1406* (2013.01); *A61J 1/1425* (2015.05); *A61J 1/201* (2015.05); *A61J 1/2041* (2015.05); *A61J 1/2096* (2013.01)

(58) Field of Classification Search
CPC ..... A61J 1/2096; A61J 1/201; A61J 1/2089; A61J 1/1418; A61J 1/2013; A61J 1/18; A61J 1/1412; A61J 1/20; A61J 1/2075; A61J 1/1468; A61J 1/1475; A61J 1/1425; A61J 1/1481; A61J 1/1487; A61J 1/16; A61J 1/2058; A61J 1/2093; A61J 2200/10; A61J 1/00
USPC ..... 604/403, 404, 411–416; 206/221
See application file for complete search history.

(56) References Cited

U.S. PATENT DOCUMENTS

| | | | | |
|---|---|---|---|---|
| 2,549,417 | A * | 4/1951 | Brown | 206/221 |
| 2,610,628 | A * | 9/1952 | Lockhart | 206/221 |
| 2,689,566 | A * | 9/1954 | Lockhart | 604/295 |
| 2,764,156 | A * | 9/1956 | Fernandez et al. | 206/221 |
| 2,764,157 | A * | 9/1956 | Fernandez et al. | 206/221 |
| 3,467,097 | A * | 9/1969 | Ogle | 206/221 |
| 5,863,126 | A * | 1/1999 | Guild | 366/130 |
| 6,021,892 | A | 2/2000 | Baudin | |
| 2007/0060877 | A1* | 3/2007 | Bassarab et al. | 604/89 |
| 2007/0129673 | A1* | 6/2007 | Bassarab et al. | 604/85 |
| 2009/0182301 | A1* | 7/2009 | Bassarab et al. | 604/416 |

FOREIGN PATENT DOCUMENTS

| | | |
|---|---|---|
| TW | 200722072 | 6/2007 |
| TW | 200730166 | 8/2007 |

* cited by examiner

*Primary Examiner* — Andrew S Lo
(74) *Attorney, Agent, or Firm* — Alan D. Kamrath; Kamrath IP Lawfirm, P.A.

(57) ABSTRACT

A multi-medicament container including a vessel body, a plurality of plungers, and a rod is disclosed. The vessel body has an opening end and a closed end. The plungers are received in the vessel body, with the plungers spaced from each other to define a plurality of chambers in the vessel body, with each of the plungers having a passage, and with the passages having a common central line. The rod detachably and fluid-tightly stuffs the passages of the plungers, with an end of the rod extending out of the vessel body from the opening end of the vessel body.

23 Claims, 8 Drawing Sheets

MULTI-MEDICAMENT CONTAINER

BACKGROUND OF THE INVENTION

1. Field of the Invention

The present invention generally relates to a multi-medicament container and, more particularly, to a multi-medicament container able to separately store different kinds of medicaments and for the various medicaments to mix before injection.

2. Description of the Related Art

Referring to FIG. 1, an invention of a Taiwan patent with patent publication number 200730166 and entitled as "Dual-Chamber Container without By-Pass" is shown. The invention regards to a medicament container 9 having a cylindrical body 91 and upper and lower closures 92, 93 separately arranged at two ends of the cylindrical body 91. A separating stopper 94 with a height "H" is provided between the two closures 92, 93, so that a top chamber 95 between the upper closure 92 and separating stopper 94 and a bottom chamber 96 between the lower closure 93 and separating stopper 94 are formed, with a liquid medicament received inside the top chamber 95 and a liquid or solid medicament received inside the bottom chamber 96. Besides, a hollow needle 97 with a length "L" is arranged on the bottom end of the upper closure 92, while an opening 971 is formed at a root end of the hollow needle 97 opposite to a tip free end of the hollow needle 97 and a distance of the length "L" is larger than another distance of the height "H."

Accordingly, when a user is going to mix these two medicaments in the medicament container 9, the user may push the upper closure 92 for the hollow needle 97 to penetrate the separating stopper 94, and thus the liquid medicament in the top chamber 95 can flow into the bottom chamber 96 through the hollow needle 97 to mix with the other medicament.

However, when the hollow needle 97 penetrates the separating stopper 94, small cut off pieces of the separating stopper 94 may clog up the passage inside the hollow needle 97 and block the liquid medicament from easily entering the bottom chamber 96, and thus this medicament container 9 cannot provide ideal mixture efficiency. Furthermore, internal pressures of the top and lower chambers 95, 96 are kept since both of the top and lower chambers 95, 96 are fluid-tightly sealed for storing the medicaments, and thus it is not easy to push the upper closure 92 toward the separating stopper 94 against the internal pressures of these chambers 95, 96 for the hollow needle 97 to penetrate the separating stopper 94.

Referring to FIG. 2, another invention of a Taiwan patent with patent publication number 200722072 and entitled as "Dual-Chamber Container without By-Pass in The Cylindrical Body" is shown. Similarly, another medicament container 8 having a cylindrical body 81 and upper and lower closures 82, 83 separately arranged at two ends of the cylindrical body 81, with a separating stopper 84 provided between the two closures 82, 83 to form a top chamber 85 between the upper closure 82 and separating stopper 84 and a bottom chamber 86 between the lower closure 83 and separating stopper 84, and with a liquid medicament received inside the top chamber 85 and a liquid or solid medicament received inside the bottom chamber 86. Specifically, a through hole 841 is formed in the separating stopper 84 and links the top and bottom chambers 85, 86, while the through hole 841 has an upper part 841*a* and a lower part 841*b* with a sectional caliber larger than that of the first section 841*a*, and a shaped member 87 movably and fluid-tightly closes off the upper part 841*a* of the through hole 841.

In use of this medicament container 8, a user may push the upper closure 82 to pressure the shaped member 87 through the internal pressure of the top chamber 85 so that the shaped member 87 can disengage from the upper part 841*a* of the through hole 841 and fall into the bottom chamber 86 for the two medicaments originally received in the two chambers 85, 86 to mix with each other in the bottom chamber 86.

However, similarly, the upper closure 82 is hard to be pressed and move toward the separating stopper 84 since the internal pressures of the top and lower chambers 85, 86 are kept for the fluid-tightly sealed top and lower chambers 85, 86. Besides, before the shaped member 87 disengages from the upper part 841*a*, the pressure may evenly distributed onto the separating stopper 84 and shaped member 87, and thus the shaped member 87 cannot easily fall into the lower chamber 86 since no device under the separating stopper 84 to limit its downward movement is arranged.

Moreover, there has to be an additional rod for pushing the upper closures 82, 92 of the medicament containers 8, 9, and this is inconvenient for the user to operate the medicament containers 8, 9.

SUMMARY OF THE INVENTION

It is therefore the primary objective of this invention to provide a multi-medicament container able to control the communication between chambers merely by a rod being pulled or not while no additional tool is needed to pull the rod.

The invention discloses a multi-medicament container including a vessel body, a plurality of plungers, and a rod. The vessel body has an opening end and a closed end. The plungers are received in the vessel body, with the plungers spaced from each other to define a plurality of chambers in the vessel body, with each of the plungers having a passage, and with the passages having a common central line. The rod detachably and fluid-tightly stuffs the passages of the plungers, with an end of the rod extending out of the vessel body from the opening end of the vessel body.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
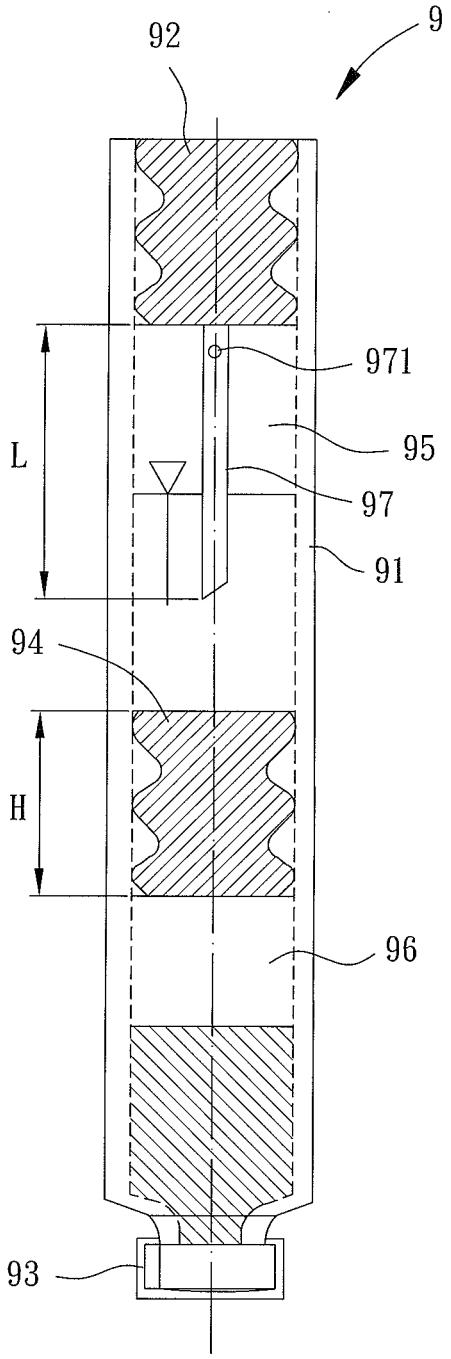
FIG. 1 PRIOR ART
FIG. 1 shows a cross-sectional diagram of a conventional medicament container.
Figure 2:
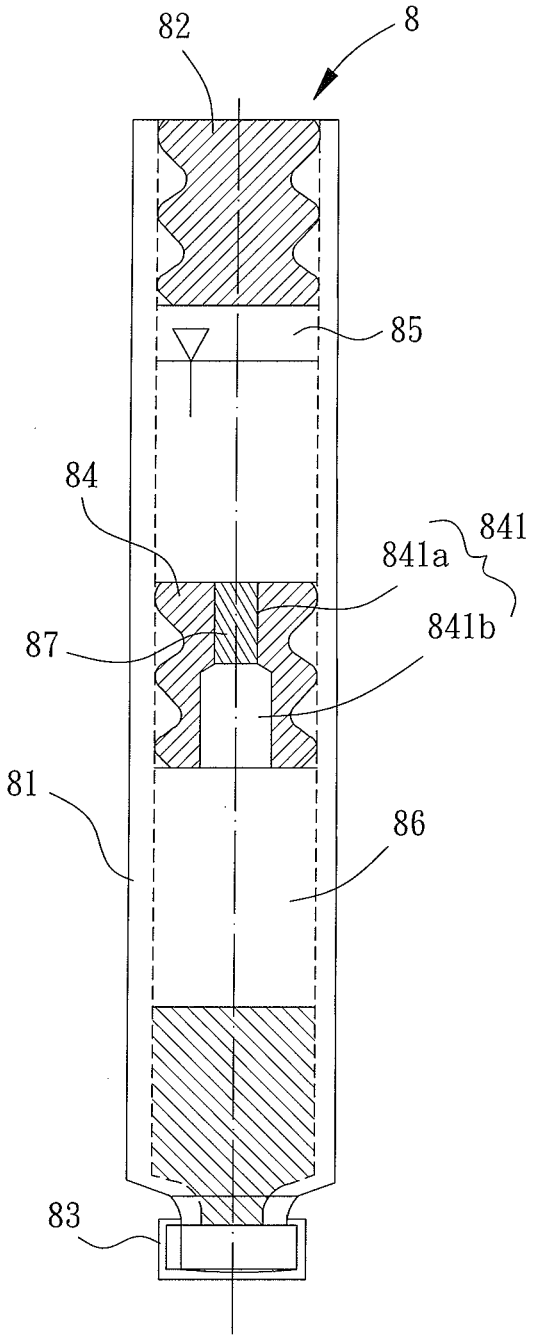
FIG. 2 PRIOR ART
FIG. 2 shows a cross-sectional diagram of another conventional medicament container.

In the various figures of the drawings, the same numerals designate the same or similar parts. Furthermore, when the term "first," "second," "third," "fourth," "fifth," "upper," "lower," "top," "bottom," and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
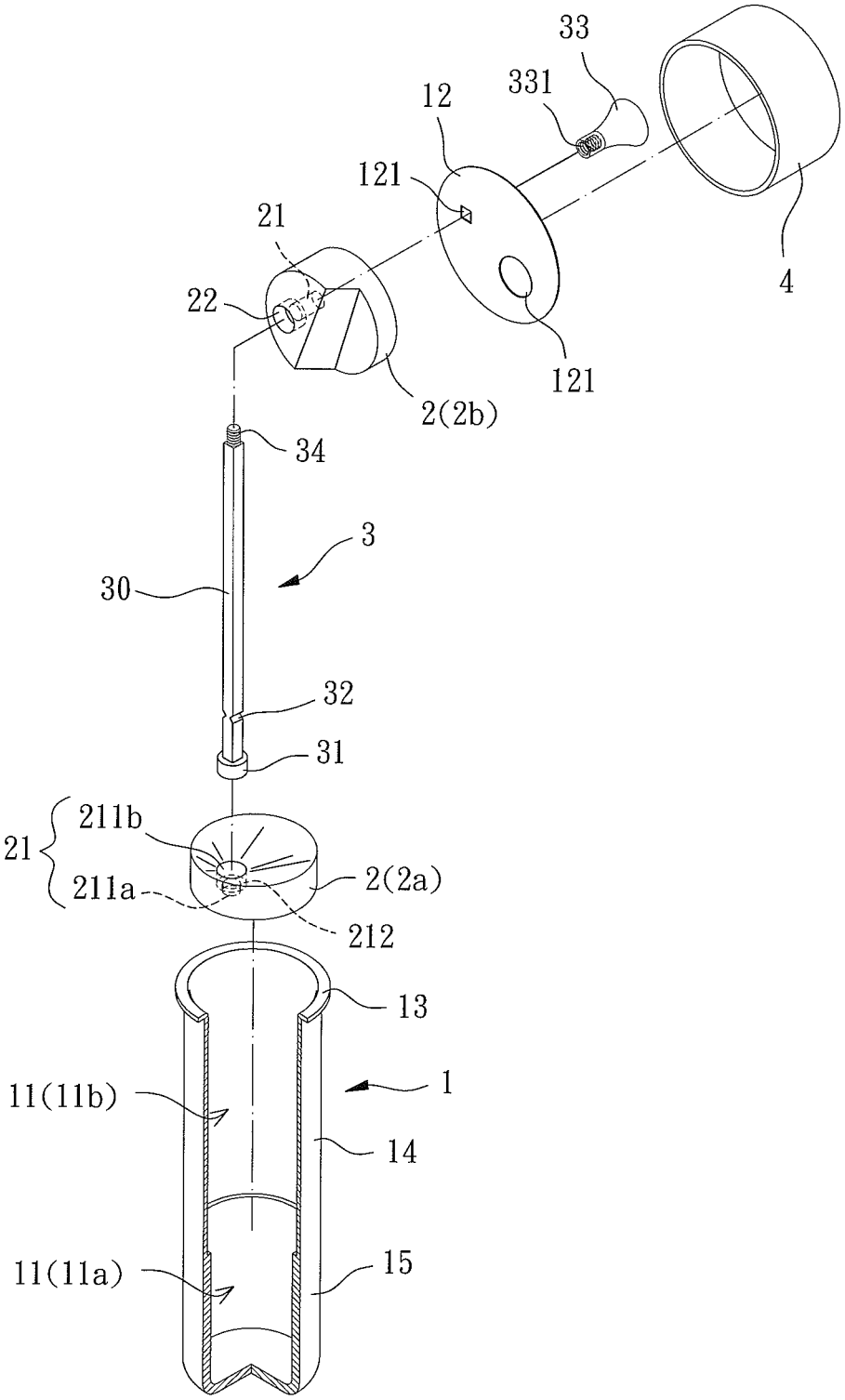
FIG. 3 shows an exploded diagram of a multi-medicament container according to a first embodiment of the invention.

FIG. 3 shows an exploded diagram of a multi-medicament container according to a first embodiment of the invention. The multi-medicament container includes a vessel body 1, a plurality of plungers 2, and a rod 3. The plungers 2 are received in the vessel body 1 and spaced from each other to define a plurality of chambers 11 for separately storing different medicaments. The rod 3 controls the communication between the plural chambers 11 so as to separate or mix the received medicaments.

The vessel body 1 has an opening end with a cap 12 covering the opening end of the vessel body 1. The cap 12 has at least one through-hole 121, and preferably there are two through-holes 121 as two eccentric openings passing through the cap 12. In this embodiment, preferably, the cap 12 is made of a crimp cap, with opening end of the vessel body 1 further including a coupling flange 13 for the cap 12 to hook. Moreover, the vessel body 1 is defined to have plural sections with different sectional calibers, while the sectional calibers are gradually decreased from the opening end of the vessel body 1 to an opposite closed end thereof, wherein a number of the sections of the vessel body 1 is in correspondence with that of the plural plungers 2. Specifically, two sections, an upper section 14 and a lower section 15, are defined in the vessel body 1 in the first embodiment, with the upper section 14 close to the opening end and the lower section 15 close to the closed end, wherein a sectional caliber of the lower section 15 is smaller than that of the upper section 14 and a step portion is formed at a border between these two sections 14, 15.

In this embodiment, there are two plungers 2 in use, which are numbered as "2*a*" and "2*b*" respectively, and diameters of the plungers 2*a*, 2*b* are equal to or slightly smaller than the sectional caliber of the upper section 14 but larger than the sectional caliber of the lower section 15. The plunger 2*a* rests on the step portion formed between the upper and lower sections 14, 15 to define a first chamber 11*a* between the plunger 2*a* and the closed end of the vessel body 1, and the plunger 2*b* is arranged adjacent to the opening end of the vessel body 1, preferably abutting against the cap 12, to define a second chamber 11*b* between the plungers 2*a*, 2*b*.

Specifically, each of the plungers 2 has a passage 21, with the passages 21 of all the plungers 2 having a common central line and in alignment with one of the two through-holes 121 of the cap 12 axially. Preferably, at least one end of the passage 21 of the plunger 2*a* is in a funnel shape for a liquid or powdery medicament to easily pass through the passage 21. Particularly, in this embodiment, the passage 21 of the plunger 2*a* includes a first part 211*a* and a second part 211*b* both in the form of a round through hole, while the first and second parts 211*a*, 211*b* are coaxial, the first part 211*a* has a caliber smaller than the caliber of the second part 211*b*, and a limiting surface 212 is formed at a border between the first and second parts 211*a*, 211*b* and faces the second chamber 11*b*. Specifically, the first part 211*a* is next to the first chamber 11*a* and the second part 211*b* is next to the second chamber 11*b*.

There may be a positioning recess 22 formed at an end of the passage 21 of the plunger 2*b*, next to the second chamber 11*b* and in alignment with the second part 211*b* of the passage 21 of the plunger 2*a*. Besides, it is preferable for the plunger 2*b* to have a thin area in alignment with the other through-hole 121 of the cap 12. Furthermore, surface of the plunger 2*b* around or next to the thin area may be an inclined surface for convenience of fluid guidance.

The rod 3 has a body 30 in the form of a rod and a positioning member 31 arranged on an end of the body 30 to form an end of the rod 3, wherein the body 30 and positioning member 31 are integrally formed or assembled together after separately formed. A shape of the positioning member 31 is corresponding to the second portion part 211*b* of the passage 21 of the plunger 2*a*. Specifically, referring to FIG. 4, when the positioning member 31 is a blocker with a sectional radius larger than that of the body 30, the positioning member 31 can be fluid-tightly inserted into the passage 21 of the plunger 2*a* to separate the first and second chambers 11*a*, 11*b*, and the limiting surface 212 can abut against the positioning member 31 and prevent it from further insertion that deforms the plunger 2*a* and deteriorates the sealing effect between the two chambers 11*a*, 11*b*.

Moreover, the rod 3 may pass through the passage 21 of the plunger 2*b* and the through-hole 121 in alignment with this passage 21, while another end of the rod 3 opposite to the end having the positioning member 31 extends out of the vessel body 1 through the through-hole 121 of the cap 12 for a user to pull. Thereby, the first and second chambers 11*a*, 11*b* communicate with each other when the positioning member 31 is pulled out of the passage 21 of the plunger 2*a*. Furthermore, there can be a neck 32 on the body 30 between the two ends thereof, wherein the neck 32 has a sectional radius smaller than that of other parts of the body 30, so that the user may break the rod 3 in the neck 32 after the positioning member 31 is pulled to a suitable position.

Additionally, there can be a handle 33 disposed at the end of the rod 3 extending out of the vessel body 1 for the user to hold. Particularly, the handle 33 has a first coupling portion 331 adapted to couple with a second coupling portion 34 at an end of the body 30 extending out of the vessel body 1, and the way by which the first and second coupling portions 331, 34 engages is screwing or fastening, but is not limited thereto. One skilled in this art may readily appreciate that the coupling portion 34 of the body 30 may have outer threads and the coupling portion 331 of the handle 33 may have corresponding inner threads for mutual screwing when the handle 33 is coupled with the body 30 by way of screwing. Moreover, a cover 4 can be mounted onto the top of the vessel body 1 to enclose parts of the rod 3 protruding out of the vessel body 1 and above the cap 12, such as the handle 33, so as to prevent these said parts from outer impact or dust.

Figure 4:
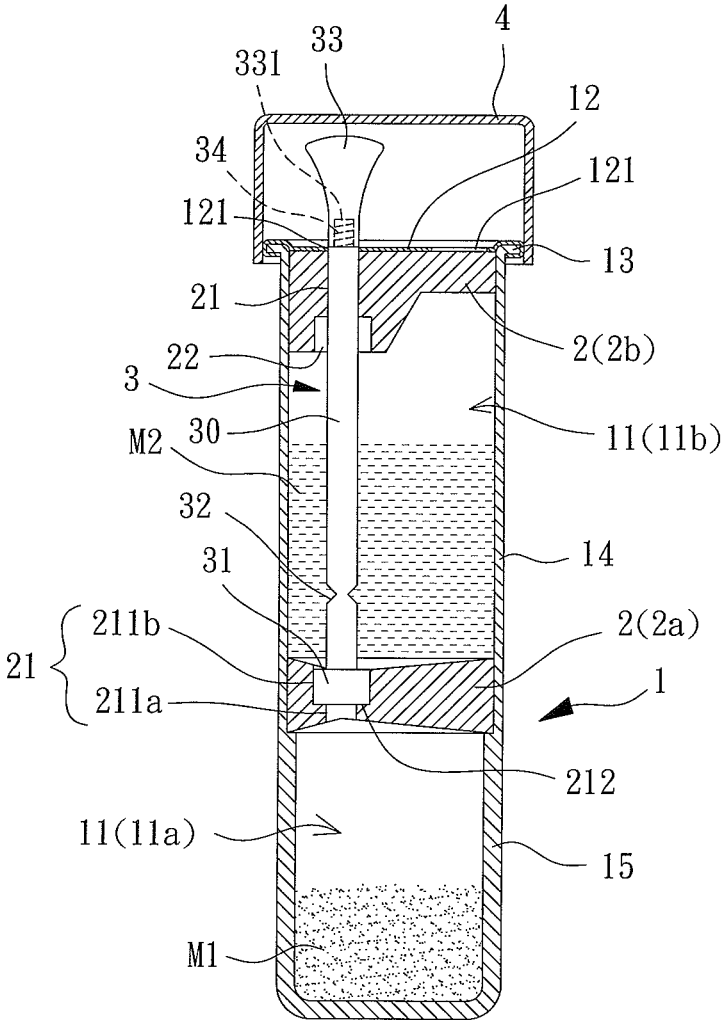
FIG. 4 shows a cross-sectional diagram of the multi-medicament container of the first embodiment of the invention.

FIG. 4 shows an assembly procedure of the multi-medicament container of the first embodiment. First, the opening end of the vessel body 1 faces upwards for a certain amount of a first medicament M1 to be poured into the vessel body 1. Next, the plunger 2*a* is inserted into the vessel body 1 and abuts against the step portion at the border between the upper section 14 and lower section 15, so that the first chamber 11*a* between the plunger 2*a* and the closed end of the vessel body 1 and receiving the first medicament M1 is formed, and then the positioning member 31 of the rod 3 is fluid-tightly stuffed into the passage 21 of the plunger 2*a* to prevent the first medicament M1 in the first chamber 11*a* from leakage.

Following, a certain amount of a second medicament M2 is poured into the vessel body 1, and the plunger 2*b* is then inserted into the vessel body 1 to a position adjacent to the opening end of the vessel body 1, with the rod 3 extending through the passage 21 of the plunger 2*b* and fluid-tightly abutting against an inner surface of the passage of the plunger 2*b*, so that the second chamber 11*b* between the two plungers 2*a*, 2*b* and receiving the second medicament M2 is formed, with the second medicament M2 being well kept in the second chamber 11*b* without any leakage. It is worth mentioning that at least one of the first and second medicaments M1, M2 is in a liquid state. The neck 32 of the rod 3 can be located in the second chamber 11*b* when the positioning member 31 remains in the passage 21 of the plunger 2*a*.

Finally, the cap 12 is coupled with the coupling flange 13 of the vessel body 1, with the rod 3 extending through the through-hole 121 of the cap 12. Preferably, the handle 33 is then coupled with the end of the body 30 extending out of the vessel body 1, and the cover 4 is mounted onto the top of the vessel body 1. With the above assembly procedure, a multi-medicament container of this invention with two different medicaments is thereby provided.

Figure 5:
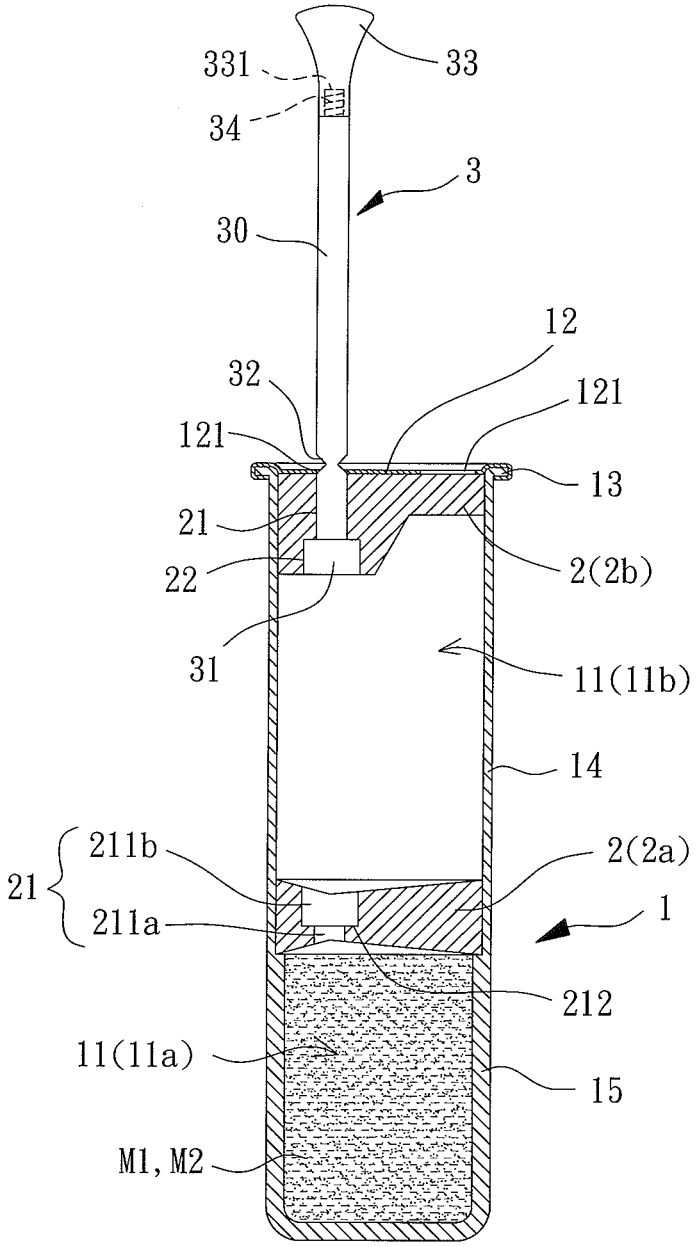
FIG. 5 shows a first operation diagram of the multi-medicament container of the first embodiment of the invention.

Referring to FIG. 5 again, when the two medicaments are going to be mixed, a user can firstly remove the cover 4 and then pull the rod 3 through the handle 33 for disengaging the positioning member 31 form the passage 21 of the plunger 21*a*, so as to enable communication between the first chamber 11*a* and the second chamber 11*b*. Accordingly, with a suitable position of the vessel body 1, the first medicament M1 or second medicament M2 which is in the liquid state, can flow into one of the chambers 11*a*, 11*b* from the other one of the chambers 11*a*, 11*b* through the passage 21 of the plunger 2*a*. In this embodiment, the first medicament M1 is in the solid state and the second medicament M2 is in the liquid state, and the vessel body 1 is kept to have its opening end faces upwards for the second medicament M2 to flow into the first chamber 11*a* from the second chamber 11*b* and to mix with the first medicament M1.

Furthermore, after the positioning member 31 of the rod 3 disengages from the passage 21 of the plunger 2*a*, the rod 3 can be further pulled outwards until the positioning member 31 reaches and abuts against the bottom face of the plunger 2*b*, and can be prevented from being totally pulled out of the vessel body 1 to reveal the passage 21 of the plunger 2*b*. Alternatively, when the positioning recess 22 is arranged, the positioning member 31 of the rod 3 can be finally pulled into the positioning recess 22. Preferably, the neck 32 is aligned with the cap 12 when the positioning member 31 abuts against the plunger 2*b* or is received in the positioning recess 22, so that the user may break the rod 3 in the neck 32 and no protrusion parts of the rod 3 may interfere with further operation of the vessel body 1.

Figure 6:
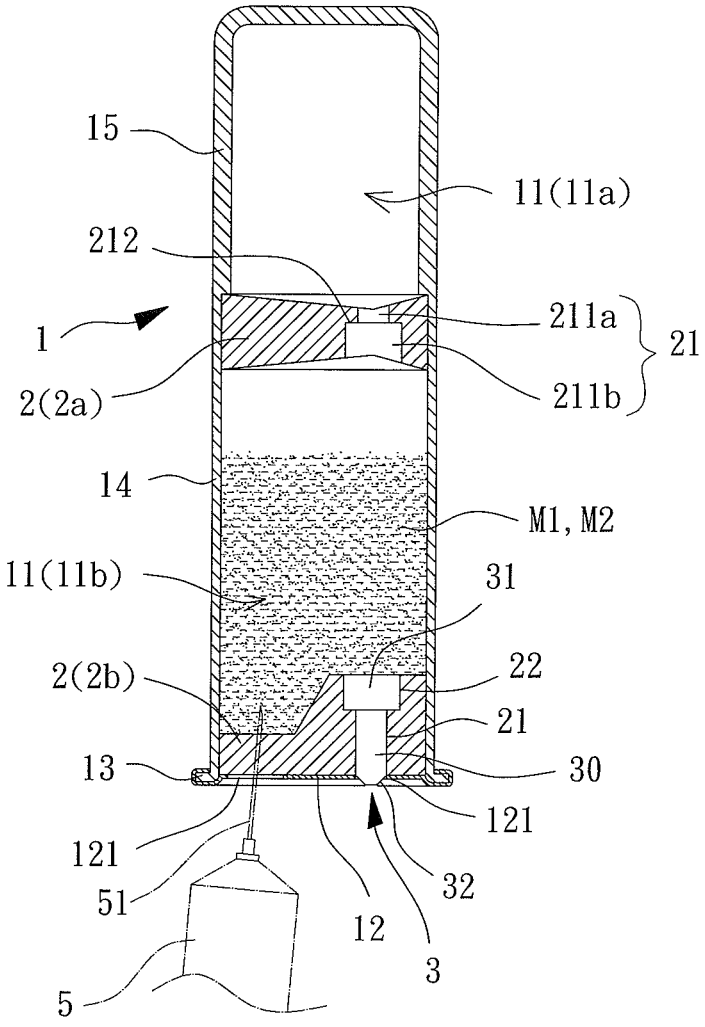
FIG. 6 shows a second operation diagram of the multi-medicament container of the first embodiment of the invention.

Referring to FIG. 6, after the first and second medicaments M1, M2 are evenly mixed, the vessel body 1 is then arranged in a reverse position for a mixture fluid of the two medicaments M1, M2 to flow into the second chamber 11*b* through the passage 21 of the plunger 2*a*. It should be noted that no matter which way is a fluid going to flow between the two chambers 11*a*, 11*b* through the passage 21 of the plunger 2*a*, it can be performed easily and smoothly once both ends of the passage 21 are in a funnel shape, and thus there will be not residual fluid in the upper one of the two chambers 11*a*, 11*b*. Finally, through the through-holes 121 of the cap 12, the user may penetrate the plunger 2*b* in the thin area by a needle 51 of a syringe 5, and draws out the said mixture fluid from the second chamber 11*b*. Similarly, residual mixture fluid is few or none since the inclined surface around or next to the thin area may efficiently guide and assemble the mixture fluid in the thin area.

Figure 7:
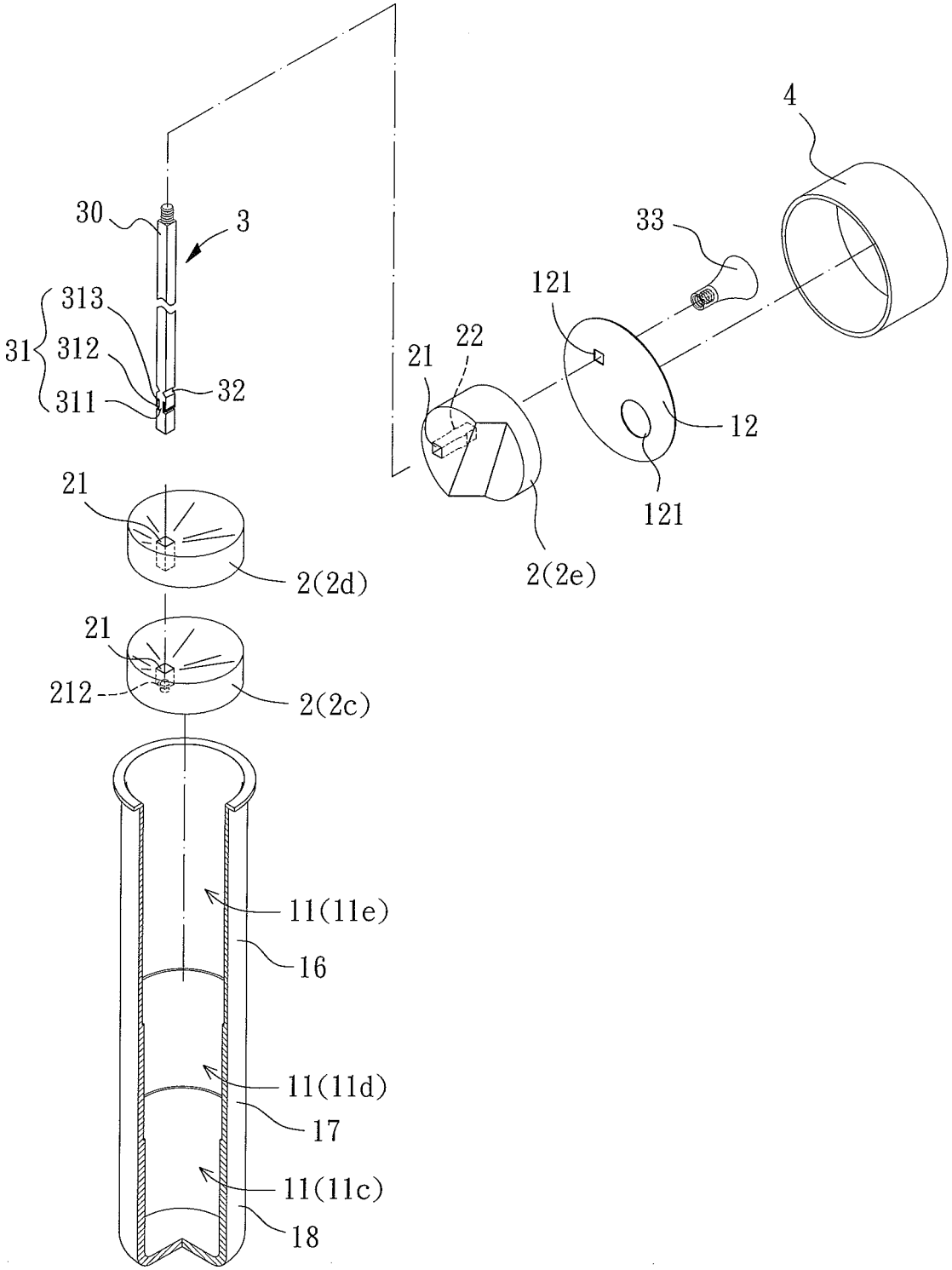
FIG. 7 shows an exploded diagram of a multi-medicament container according to a second embodiment of the invention.

FIG. 7 shows a perspective view of a multi-medicament container according to a second embodiment of the invention. In comparison with the first embodiment, the multi-medicament container of the second embodiment is able to store different medicaments with a number no less than three. The following illustration is for storing three different medicaments, and a container for storing medicaments more than three kinds can be obtained in the same way.

In the present embodiment, three sections, an upper section 16, a middle section 17 and a lower section 18, are defined in the vessel body 1, with the upper section 16 close to the opening end, the lower section 18 close to the closed end, and the middle section 17 lying between the upper and lower sections 16, 18, wherein a sectional caliber of the middle section 17 is smaller than that of the upper section 16, a sectional caliber of the lower section 18 is smaller than that of the middle section 17, and two step portions are respective formed at borders between these sections 16, 17, 18. Besides, there are three plungers 2 in use, which are numbered as "2*c*," "2*d*" and "2*e*" respectively. Diameters of the plungers 2*d*, 2*e* are equal to or slightly smaller than the sectional caliber of the upper section 16 but larger than the sectional caliber of the middle section 17, and a diameter of the plunger 2*c* is equal to or slightly smaller than the sectional caliber of the middle section 17 but larger than the sectional caliber of the lower section 18.

The plunger 2*c* rests on the step portion formed between the middle and lower sections 17, 18 to define a third chamber 11*c* between the plunger 2*c* and the closed end of the vessel body 1; the plunger 2*d* rests on the step portion formed between the upper and middle sections 16, 17 to define a fourth chamber 11*d* between the plungers 2*c*, 2*d*; and the plunger 2*e* is arranged adjacent to the opening end of the vessel body 1, preferably abutting against the cap 12, to define a fifth chamber 11*e* between the plungers 2*d*, 2*e*. There are also passages 21 formed in the plungers 2*c*, 2*d*, 2*e*, wherein passages 21 of the plungers 2*d*, 2*e* are similar to the passage 21 of the plunger 2*b*, and the passage 21 of the plunger 2*c* is similar to the passage 21 of the plunger 2*a* to coaxially include two parts, with one of the two parts, which is next to the third chamber 11*c*, having a radius smaller than the radius of the other part so as to form a limiting surface 212 facing the fourth chamber 11*d*. Besides, the passage 21 of the plunger 2*e* can also have a positioning recess 22 while the plunger 2*e* has a thin area in alignment with the other through-hole 121 of the cap 12, with an inclined surface of the plunger 2*b* around or next to the thin area for convenience of fluid guidance.

In this embodiment, the positioning member 31 is formed in an intermediate section of the body 30 while being distant from an end of the body 30, which is disposed inside the vessel body 1, with a predetermined distance. The said end of the body 30 can be fluid-tightly stuffed in the passage 21 of the plunger 2*c* to separate the third chamber 11*c* and fourth chamber 11*d*, with the limiting surface 212 able to prevent the body 30 from further insertion that deforms the plunger 2*c* and deteriorates the sealing effect between the two chambers 11*c*, 11*d*.

Figure 8:
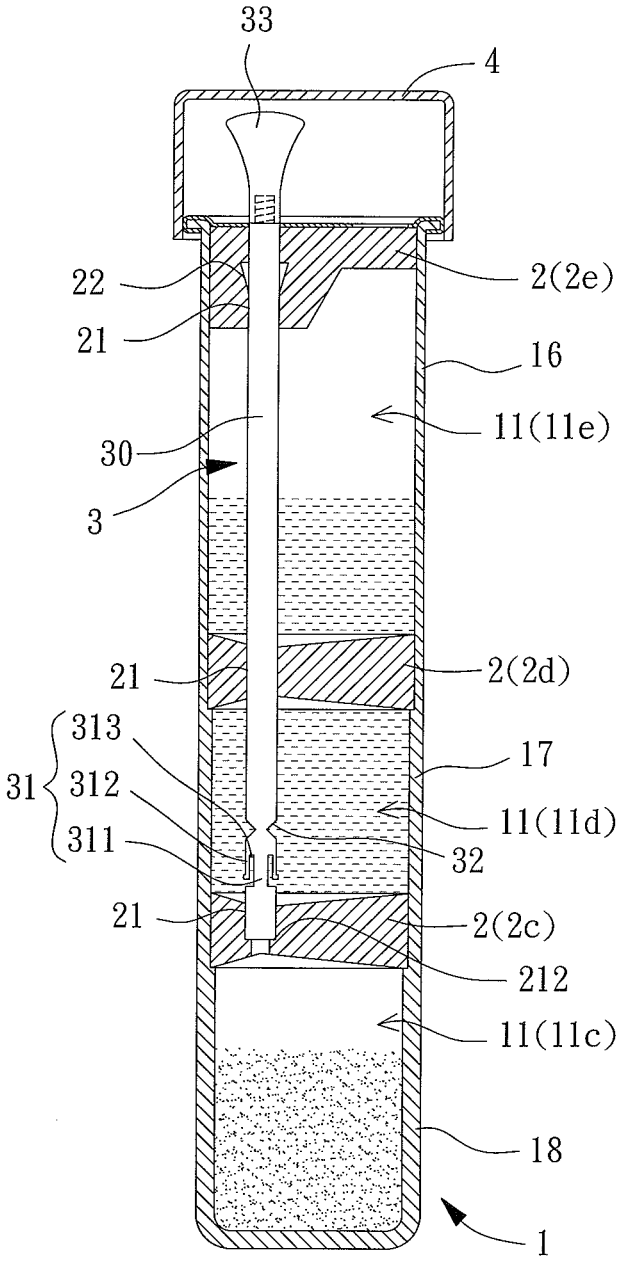
FIG. 8 shows a cross-sectional diagram of the multi-medicament container of the second embodiment of the invention.

Referring to FIG. 8, the positioning member 31 has a reduced portion 311 and at least one engaging portion 312, wherein a sectional radius of the reduced portion 311 is smaller than that of the body 30, and the at least one engaging portion 312 is arranged around and radially spaced from the reduced portion 311 to form a groove 313 between the reduced portion and the at least one engaging portion 312 for the engaging portion 312 to be elastically bent. In this embodiment, the number of the at least one engaging portion 312 is two, while these two engaging portions 312 are oppositely and redially disposed on two lateral sides of the reduced portion 311. Furthermore, when the said end of the body 30 is fluid-tightly stuffed in the passage 21 of the plunger 2*c*, the positioning member 31 is disposed in the fourth chamber 11*d*.

Moreover, the rod 3 may pass through the passages 21 of the plungers 2*e*, 2*d* and the through-hole 121 in alignment with these passages 21, while another end of the rod 3 opposite to the end having the positioning member 31 extends out of the vessel body 1 through the through-hole 121 of the cap 12 for the user to pull. Thereby, the third and fourth chambers 11*c*, 11*d* communicate with each other when the body 30 is pulled out of the passage 21 of the plunger 2*c*. Furthermore, there can be a neck 32 on the body 30 between the two ends thereof, wherein the neck 32 has a sectional radius smaller than that of other parts of the body 30, so that the user may break the rod 3 in the neck 32 after the positioning member 31 is pulled to a suitable position.

Figure 9:
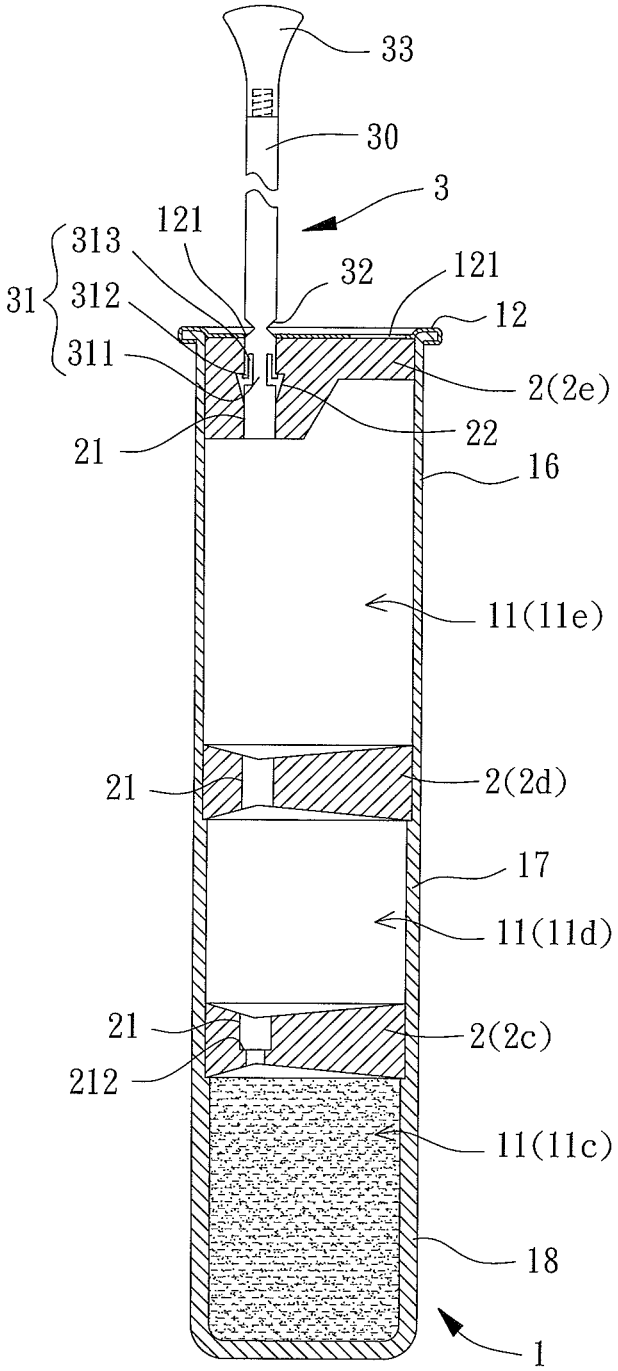
FIG. 9 shows an operation diagram of the multi-medicament container of the second embodiment of the invention.

Referring to FIG. 9, when the separately stored medicaments are going to be mixed, a user can pull the rod 3 through the handle 33 for disengaging the body 30 of the rod 3 from the passage 21 of the plunger 21*c*, so as to enable communication between the third chamber 11*c* and the fourth chamber 11*d*. Accordingly, a medicament originally stored in the fourth chamber 11*d* may go through the passage 21 of the plunger 2*c* and flow into the third chamber 11*c* to mix with another medicament therein.

The user can further pull the rod 3 outwards to let the end of the body 30 originally stuffed in the passage 21 of the plunger 2*c* pass through the passage 21 of the plunger 2*d*, so as to reveal the passage 21 of the plunger 2*d*, which communicates the fourth chamber 11*d* and the fifth chamber 11*e*, and thus a medicament originally stored in the fifth chamber may pass through the passages 21 of the plungers 2*d*, 2*c* to mix with the other medicaments. Specifically, when the positioning member 31 enters the passage 21 of the plunger 2*d*, the at least one engaging portion 312 is firstly bent to reduce the outer radius of the positioning member 31, and then the at least one engaging portion 312 will recover its position once the positioning member 31 totally passes through the passage 21 of the plunger 2*d*.

Next, the rod 3 can be further pulled outwards until the positioning member 31 enters the passage 21 of the plunger 2*e*, with an end of the engaging portion 312 extending into the positioning recess 22 of the plunger 2*e* to stop the movement of the rod 3.

Preferably, the neck 32 is aligned with the cap 12 when the positioning member 31 is stuck in the passage 21 of the plunger 2*e*, so that the user may break the rod 3 in the neck 32 and no protrusion parts of the rod 3 may interfere with further operation of the vessel body 1. Finally, after the medicaments are evenly mixed, the vessel body 1 is then arranged in a reverse position for a mixture fluid of these medicaments to flow into the fifth chamber 11*e* through the passages 21 of the plungers 2*c*, 2*d*, so that the user may draws out the said mixture fluid from the fifth chamber 11*e* by a syringe 5.

Specifically, if both of the medicaments in the third and fourth chambers 11*c*, 11*d* are in the liquid state, the rod 3 can be directly pulled to a position wherein the positioning member 31 is stuck in the passage 21 of the plunger 2*e* for these fluid medicaments to flow into the fifth chamber 11*e*. However, once any one of the medicaments in the third and fourth chambers 11*c*, 11*d* is in the solid state, before the rod 3 is pulled to a position wherein the positioning member 31 is stuck in the passage 21 and the passage 21 of the plunger 2*d* is revealed, the rod 3 should be pulled to a position wherein the passage 21 of the plunger 2*c* is revealed but the passage 21 of the plunger 2*d* is still stuffed by the body 30 for the solid medicament to be evenly melted in the liquid medicament.

In sum, in use of the multi-medicament container of this invention, none of the chambers 11 has to be compressed, and communication between any two chambers can be achieved merely by pulling out the rod 3 for stored medicaments to be mixed without any additional tool.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A multi-medicament container comprising:

a vessel body having an opening end and a closed end;

a plurality of plungers received in the vessel body, with the plurality of plungers spaced from each other to define a plurality of chambers in the vessel body, with each of the plurality of plungers having a passage, and with the passages of the plurality of plungers having a common central line; and a rod detachably and fluid-tightly stuffing the passages of the plurality of plungers, with an end of the rod extending out of the vessel body from the opening end of the vessel body, wherein the passage of one of the plurality of plungers, which is closest to the closed end of the vessel body among the plurality of plungers, includes coaxial first and second parts, wherein the first part has a caliber smaller than a caliber of the second part, wherein the first part is next to one of the plurality of chambers, which is closest to the closed end of the vessel body among the plurality of chambers, and wherein a limiting surface is formed at a border between the first and second parts.

2. The multi-medicament container as claimed in claim 1, wherein the rod has a rod body and a positioning member arranged on an end of the rod body, wherein the caliber of the second part is larger than a sectional diameter of the rod body of the rod, wherein the passage of another one of the plurality of plungers, which is closest to the opening end of the vessel body among the plurality of plungers, has a positioning recess, wherein a sectional shape of the positioning recess is equal to a sectional shape of the second part, and wherein a sectional shape of the positioning member corresponds to those of the positioning recess and the second part.

3. The multi-medicament container as claimed in claim 1, wherein the rod has a rod body and a positioning member formed in an intermediate section of the rod body, wherein the positioning member has a reduced portion and at least one engaging portion, wherein a sectional radius of the reduced portion is smaller than a sectional radius of the rod body, wherein the at least one engaging portion is arranged around and radially spaced from the reduced portion to form a groove between the reduced portion and the at least one engaging portion, and wherein the passage of another one of the plurality of plungers, which is closest to the opening end of the vessel body among the plurality of plungers, has a positioning recess adapted to engage with the at least one engaging portion.

4. The multi-medicament container as claimed in claim 2 further comprising a cap covering the opening end of the vessel body, wherein the cap has at least one through-hole and the other one of the plurality of plungers closest to the opening end among the plurality of plungers abuts against the cap.

5. The multi-medicament container as claimed in claim 3 further comprising a cap covering the opening end of the vessel body, wherein the cap has at least one through-hole and the other one of the plurality of plungers closest to the opening end among the plurality of plungers abuts against the cap.

6. The multi-medicament container as claimed in claim 4, wherein the at least one through-hole are two eccentric openings passing through the cap.

7. The multi-medicament container as claimed in claim 5, wherein the at least one through-hole are two eccentric openings passing through the cap.

8. The multi-medicament container as claimed in claim 6, wherein the passages of the plurality of plungers have the common central line and in alignment with one of the two eccentric openings axially.

9. The multi-medicament container as claimed in claim 7, wherein the passages of the plurality of plungers have the common central line and in alignment with one of the two eccentric openings axially.

10. The multi-medicament container as claimed in claim 8, wherein the other one of the plurality of plungers closest to the opening end among the plurality of plungers has a thin area in alignment with another one of the two eccentric openings of the cap axially.

11. The multi-medicament container as claimed in claim 9, wherein the other one of the plurality of plungers closest to the opening end among the plurality of plungers has a thin area in alignment with the two eccentric openings of the cap axially.

12. The multi-medicament container as claimed in claim 10, wherein a surface of the other one of the plurality of plungers around or next to the thin area is an inclined surface.

13. The multi-medicament container as claimed in claim 11, wherein a surface of the other one of the plurality of plungers around or next to the thin area is an inclined surface.

14. The multi-medicament container as claimed in claim 2, wherein the vessel body has plural sections with different sectional calibers, wherein the different sectional calibers are gradually decreased from the opening end to the closed end, and wherein a number of the plural sections of the vessel body is in correspondence with a number of the plurality of plungers.

15. The multi-medicament container as claimed in claim 3, wherein the vessel body has plural sections with different sectional calibers, wherein the different sectional calibers are gradually decreased from the opening end to the closed end, and wherein a number of the plural sections of the vessel body is in correspondence with a number of the plurality of plungers.

16. The multi-medicament container as claimed in claim 2, wherein at least one end of the passages of the plurality of plungers except for the passage of the other one of the plurality of plungers closest to the opening end is in a funnel shape.

17. The multi-medicament container as claimed in claim 3, wherein at least one end of the passages of the plurality of plungers except for the passage of the other one of the plurality of plungers closest to the opening end is in a funnel shape.

18. The multi-medicament container as claimed in claim 2, wherein a neck is formed on the rod body of the rod, and wherein the neck has a sectional radius smaller than that of other parts of the rod body.

19. The multi-medicament container as claimed in claim 3, wherein a neck is formed on the rod body of the rod, and wherein the neck has a sectional radius smaller than that of other parts of the rod body.

20. The multi-medicament container as claimed in claim 2, wherein an end of the rod body of the rod extends out of the vessel body from the opening end and has a coupling portion, and wherein a handle is coupled with the coupling portion to form the end of the rod extending out of the vessel body.

21. The multi-medicament container as claimed in claim 3, wherein an end of the rod body of the rod extends out of the vessel body from the opening end and has a coupling portion, and wherein a handle is coupled with the coupling portion to form the end of the rod extending out of the vessel body.

22. The multi-medicament container as claimed in claim 2 further comprising a cover mounted on the vessel body to enclose a part of the rod protruding out of the vessel body.

23. The multi-medicament container as claimed in claim 3 further comprising a cover mounted on the vessel body to enclose a part of the rod protruding out of the vessel body.

* * * * *